US005862989A

United States Patent [19]

Cirillo

[11] Patent Number: 5,862,989

[45] Date of Patent: Jan. 26, 1999

[54] SPRAY GUN COVER

[76] Inventor: Jeffery C. Cirillo, 21721-8th Pl. West, Bothell, Wash. 98021

[21] Appl. No.: 881,317

[22] Filed: Jun. 25, 1997

[51] Int. Cl.[6] ..... B05B 1/28

[52] U.S. Cl. ..... 239/288; 239/288.3; 150/161

[58] Field of Search ..... 239/104, 288, 239/288.3, 288.5; 222/182; 219/227–229; 118/300; 2/16, 158, 161.6; 150/154, 161

[56] References Cited

U.S. PATENT DOCUMENTS

| | | | |
|---|---|---|---|
| 2,132,570 | 10/1938 | Leone | 219/112 |
| 2,337,767 | 12/1943 | Paul | 219/120 |
| 2,438,791 | 3/1948 | Sandrik | 2/17 |
| 2,755,477 | 7/1956 | Hubbman | 2/17 |
| 3,374,487 | 3/1968 | Slimovitz | 2/161.6 |
| 3,674,074 | 7/1972 | Lavis | 150/52 R |
| 3,883,897 | 5/1975 | Lefkowitz et al. | 2/161 |
| 4,660,610 | 4/1987 | McIntire, III | 150/52 |
| 4,967,419 | 11/1990 | Elliott | 2/16 |
| 5,332,156 | 7/1994 | Wheeler | 239/288 |
| 5,360,165 | 11/1994 | Singhal | 239/122 |
| 5,405,087 | 4/1995 | Waryu et al. | 239/288 |

*Primary Examiner*—Andres Kashnikow
*Assistant Examiner*—Lisa Ann Douglas
*Attorney, Agent, or Firm*—Dean A. Craine

[57] ABSTRACT

A cover for a spray gun designed to be placed over a spray gun when spraying to prevent overspray on the spray gun and the user's hand and forearm. The cover is made from a thin panel made of flexible fabric or paper. The panel is of sufficient size and shape so that when its lateral edges are attached together, it forms a partially enclosed structure which covers the assembled spray gun and the user's hand when operating the spray gun. Formed along the front section of the cover is a front opening which enables the tip of the spray gun to extend through the cover when the spray gun is placed inside the cover. The rear edges of the panel are unattached thereby forming a wide rear opening into the cover so that the spray gun and user's hand may be easily inserted into the cover to operate the spray gun. An optional top opening is also created on the panel which allows a hook element on the spray gun to extend through so that the spray gun may be temporarily suspended from a hook in between uses.

6 Claims, 3 Drawing Sheets

SPRAY GUN COVER

BACKGROUND OF THE INVENTION

1. Field of the Invention

This invention relates to fluid sprinkling, spraying and diffusing devices, and more particularly, to guards or protectors for such devices.

2. Description of the Related Art

Spray guns are commonly used to spray paints and stains on surfaces. One drawback to using a spray gun is that the paint or stain during use is deposited on the spray gun and the operator's hands. A substantial amount of time is therefore spent cleaning the spray gun and the operator's hand after each use.

In order to reduce the amount of time spent cleaning, a removable cover is needed that can be easily attached over the spray gun and the operator's hand just before it is used. The cover should enable the operator to fully operate the spray gun and allow the spray gun to be temporarily suspended from a hook in between uses. The cover should also be made of a durable material capable of being independently cleaned with paint thinner or water. The cover can also be made of inexpensive, disposable material so that it can be thrown-away after a single use.

SUMMARY OF THE INVENTION

It is an object of the invention to provide an attachable cover for a spray gun that protects the spray gun and the operator's hand.

It is another object of the invention to provide such a cover that can be easily installed and removed from an assembled spray gun.

It is a further object of the invention to provide such a cover that can be made of either durable, washable material or inexpensive, disposable material.

These and other objects of the invention are met by a spray gun cover designed to be placed over an assembled spray gun which allows the spray gun to be used and protects the spray gun and operator's hand from overspray. The cover comprises a thin panel made of flexible material, such as fabric or paper. The panel is of sufficient size and shape so that when folded over along its mid-line axis, it fully encloses an assembled spray gun and the user's hand operating the spray gun. Formed along the front section of the cover is a front opening which enables the tip of the spray gun to extend through the cover during use. The rear edge of the panel is unattached thereby forming a wide rear opening into the cover so that the spray gun and user's hand may be easily installed and removed from the cover. An optional top opening is also formed on the panel which allows a hook element on the spray gun to extend through so that the spray gun may be temporarily hung from a hook between uses.

DESCRIPTION OF THE PREFERRED EMBODIMENT(S)

Figure 1:
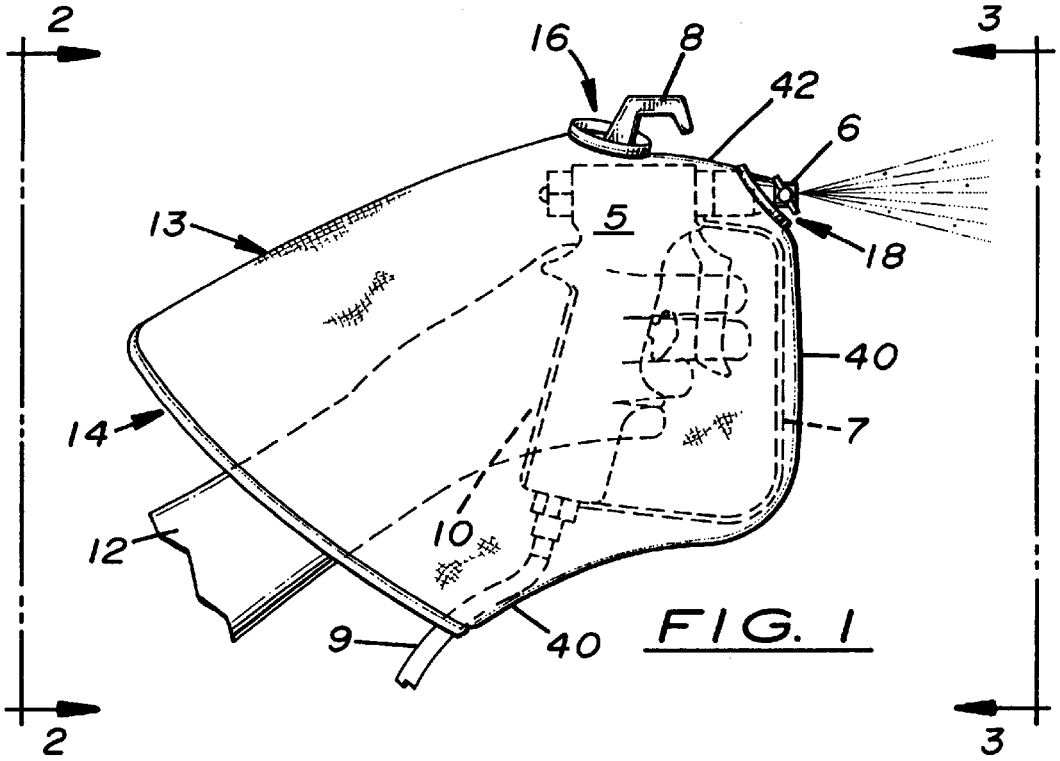
FIG. 1 is a side elevational view of the spray gun cover disclosed herein with a spray gun inserted into the cover and the user's hand operating the spray gun.
Figure 3:
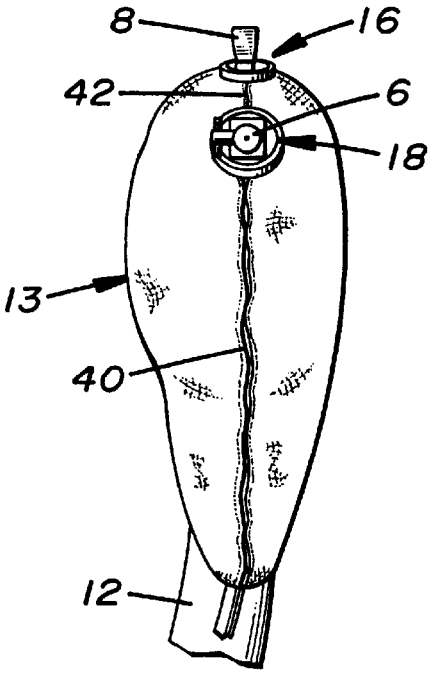
FIG. 3 is a front elevational view taken along line 3—3 in FIG. 2.
Figure 2:
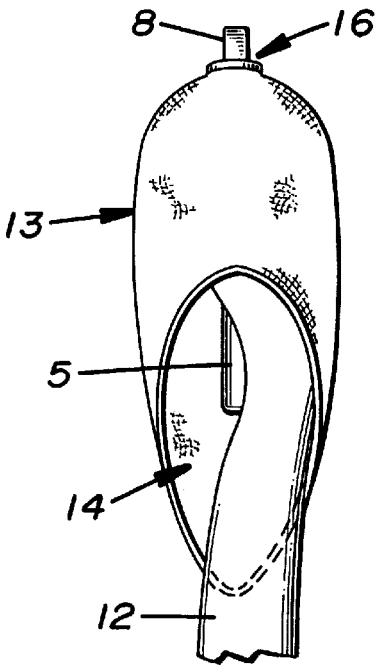
FIG. 2 is a rear elevational view taken along line 2—2 in FIG. 1.

Referring to the FIGS. 1–7, a spray gun cover, generally referred to as 13, is designed to be placed over a standard spray gun 5 having a tip 6, a guard 7, a hook element 8, and attached to an air hose 9. The cover 13 is designed to prevent overspray on the spray gun 5, user's hand 10 and forearm 12 during use.

Figure 4:
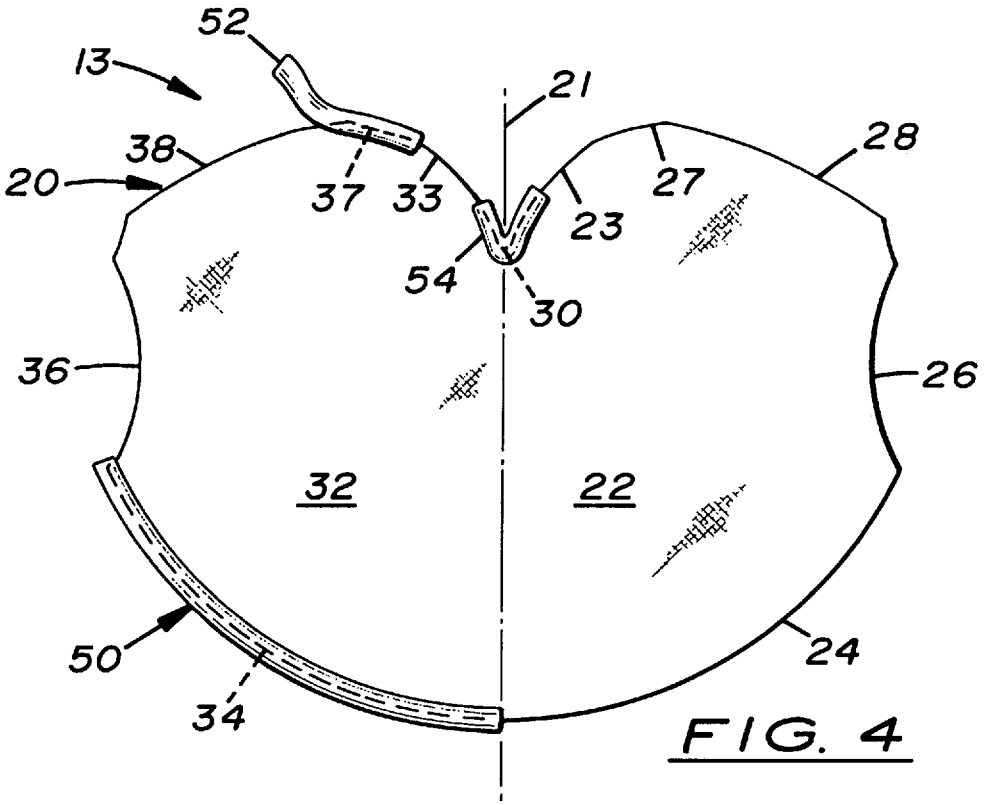
FIG. 4 is a top plan view of the panel cut to size and displayed before being assembled.

The cover 13 comprises a panel 20 made of thin, flexible material, such as fabric or paper. As shown in FIG. 4, the panel 20 is a butterfly wing-shaped structure which, when folded over it's mid-line axis 21 and connected together along it's lateral and front edges, forms a partially enclosed structure. Created along the front section of the cover 13 is a front opening 18 which enables the tip 6 of the spray gun 5 to extend through the cover 13 during use. The rear edges 24, 34 of the panel 20 are unattached thereby creating a wide, rear opening 14 into the cover 13. An optional top opening 16 is also created on the cover 13 which allows a hook element 8, commonly found on spray guns 5, to extend through.

To assemble the cover 13, the right and left sides 22, 32 respectively, of the panel 13 are folded,over each other around the mid-line axis 21. The bottom edges 26, 36 and the front edges 28, 38 of the right and left sides 22, 32, respectively, are registered and sewn together. The top edges 23, 33 on the right and left sides 22, 32, respectively, are registered and sewn together. The top lateral edges 27, 37 on the right and left sides 22, 32 respectively are unattached thereby forming the front opening 18. Formed on the front section of the panel 20 is a V-shaped cut-out. The legs of the V-shaped cut-out may be unattached thereby forming the top opening 16. Optional bindings 52, 54 may be used around the edge of the top and front openings 16, 18 to prevent fraying. As mentioned above, the rear edges 24, 34 of the right and left sides 22, 32 respectively, of the panel 20 are unattached thereby forming the rear opening 14. An optional binding 54 may also be used around the rear opening 14 to prevent fraying.

Figure 5:
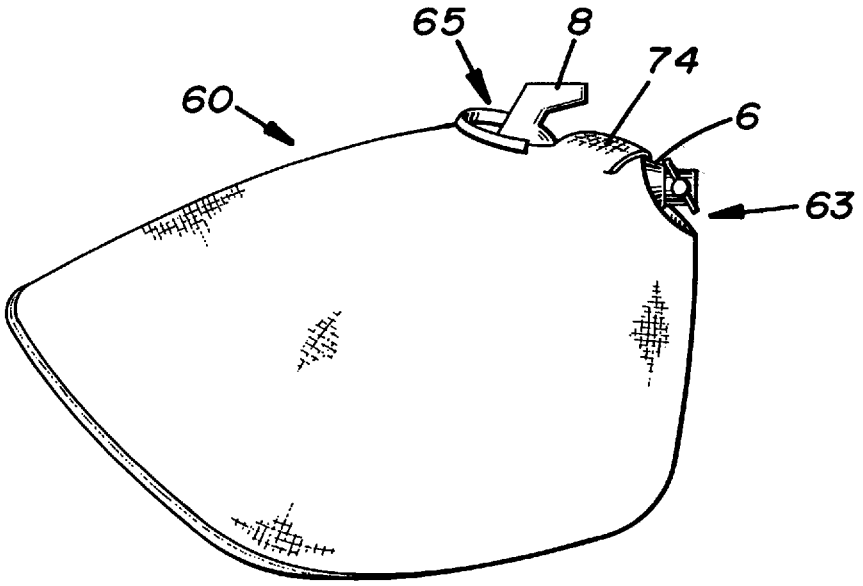
FIG. 5 is a right side elevational view of another embodiment of the spray gun cover.
Figure 6:
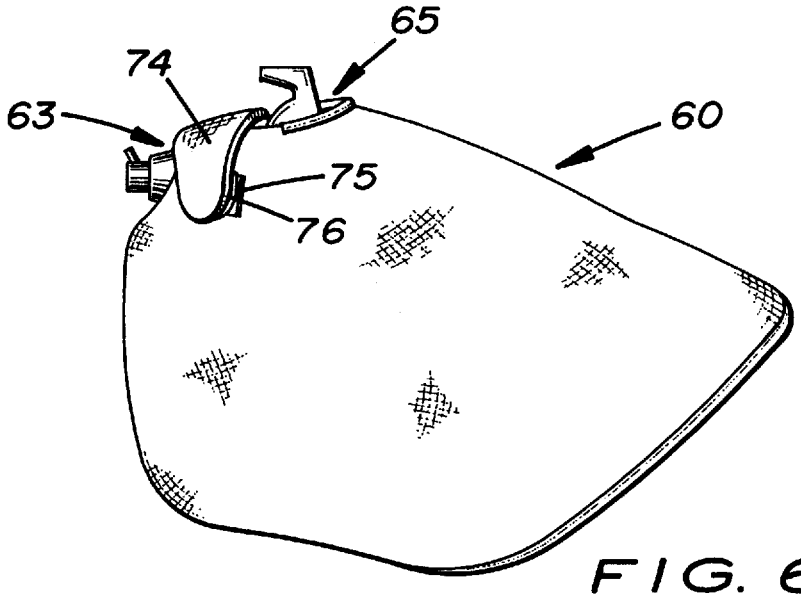
FIG. 6 is a left side elevational view of the embodiment shown in FIG. 5.

FIGS. 5 and 6 show another embodiment of the cover 60 wherein the front opening 63 and top opening 65 are formed by extending a strap 74 from one side of the panel 70 over the mid-line axis 21 and attaching it to the opposite top surface of the panel 70. Pads 75, 76 of hook and loop material, respectively, are attached to the adjoining surface on the strap 74 and top surface of panel 70, respectively, which are used to adjustably attach the strap 74 to the side of panel 70. By extending strap 74 across the mid-line axis 21 in this manner, the front and top openings 63, 65, respectively, are combined to create a larger opening which allows a completely assembled spray gun to be inserted into the cover 60 without having to remove the tip 6 from the body of the spray gun 5. The strap 74 can also be used to adjust the size of the front and top opening 63, 65, respectively, for different types of spray guns 5.

Figure 7:
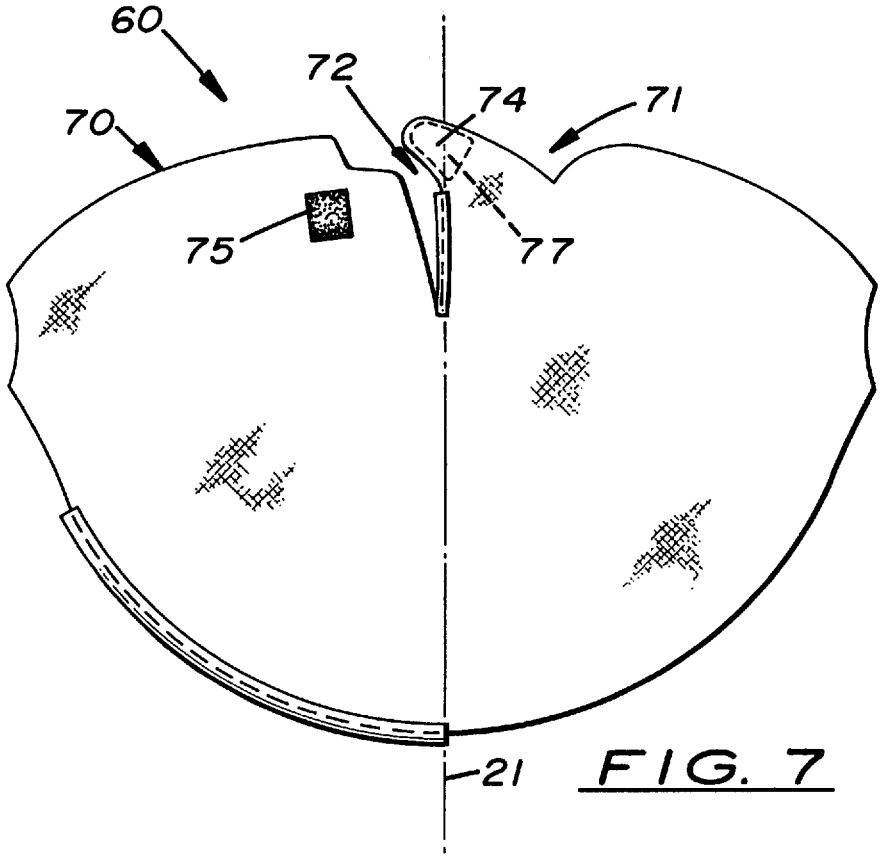
FIG. 7 is a top plan view of the panel used to manufacture the embodiment shown in FIGS. 5 and 6 cut to size and displayed before being assembled.

FIG. 7 is a top plan view of the panel 70 used to manufacture the embodiment shown in FIGS. 5 and 6. A cut-out is made along the front edge of the panel 70 and a rearward extending slot 72 is formed on the panel 70 which is slightly offset from the mid-line axis 21. The panel material located adjacent to the slot 72 forms strap 74 as shown in FIGS. 5 and 6.

In compliance with the statute, the invention, described herein, has been described in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. A cover for a spray gun, comprising:

a. a panel made of flexible material capable of being folded to form an enclosure designed to cover a spray gun;

b. a rear opening formed on said panel enabling a spray gun to be placed inside said panel when folded;

c. a front opening formed on said panel enabling the tip of the spray gun to extend from said panel; and, d. a top opening formed on said panel, said top opening enabling a hook element on the spray gun to extend through said panel when the spray gun is placed therein.

2. A cover, as recited in claim 1, wherein said panel is made of durable material capable of being cleaned.

3. A cover, as recited in claim 2, wherein said panel is made of fabric.

4. A cover, as recited in claim 1, wherein said panel is made of paper.

5. A cover, as recited in claim 1, wherein said front opening is formed by creating a rearward, extending slot in said panel and attaching an adjustable strap disposed on one side of said slot, said strap capable of being transversely extended over said slot and attached to the opposite side of said panel thereby forming said front opening.

6. A cover, as recited in claim 5, wherein said strap is adjustably attached to said panel with hook and loop connectors.

* * * * *